US005351741A

United States Patent [19]

Swopes

[11] Patent Number: 5,351,741

[45] Date of Patent: Oct. 4, 1994

[54] VERTICAL BLIND WITH RELEASABLE CARRIAGE LATCH

[75] Inventor: Cletis F. Swopes, Madison, Wis.

[73] Assignee: Springs Window Fashions Division, Inc., Middleton, Wis.

[21] Appl. No.: 83,310

[22] Filed: Jun. 25, 1993

[51] Int. Cl.[5] ..... E06B 9.30

[52] U.S. Cl. ..... 160/168.1; 160/178.1

[58] Field of Search ..... 160/166.1 V, 168.1 V, 160/172 V, 173 V, 176.1 V, 177 V, 178.1 V

[56] References Cited

U.S. PATENT DOCUMENTS

| | | | |
|---|---|---|---|
| 3,106,240 | 10/1963 | Weber | 160/168.1 V |
| 3,157,223 | 11/1964 | Arena et al. . | |
| 4,214,622 | 7/1980 | Debs | 160/176.1 V X |
| 4,257,470 | 3/1981 | Woodle | 160/176.1 V X |
| 5,090,467 | 2/1992 | Smuckler . | |
| 5,168,913 | 12/1992 | Haines | 160/168.1 V |

*Primary Examiner*—David M. Purol
*Attorney, Agent, or Firm*—Vernon J. Pillote

[57] ABSTRACT

A vertical blind apparatus of the type having a head-rail channel and a plurality of panel support carriages guidably mounted on carriage support flanges on the side walls of the channel, and a mechanism for releasably retaining the trail carriage at a selected location along the head-rail. The trail carriage retaining mechanism is formed of resilient synthetic resin material and includes an elongated base mounted on one side wall of the channel and an elongated latch member having forward and rear resilient end portions formed integrally with the base. The latch member has a forward ramp portion that diverges rearwardly from the forward end portion relative to one side wall of the channel; a rearwardly facing stop shoulder intermediate the ends of the latch member; and a finger pad portion rearwardly of the stop shoulder. The ramp portion is disposed in the path of movement of a part of the trail carriage and the forward resilient portion of the latch member is arranged to yield and allow the ramp portion to be deflected laterally when the trail carriage is moved in a rearward direction along the path. The rearwardly facing stop shoulder is engageable with the trail carriage to inhibit forward movement of the trail carriage and a finger pad is provided on the latch member and operative to deflect the rear resilient portion and allow the latch member to shift toward the side wall of the channel and disengage the stop shoulder.

8 Claims, 1 Drawing Sheet

VERTICAL BLIND WITH RELEASABLE CARRIAGE LATCH

BACKGROUND OF THE INVENTION

The invention relates to vertical blinds of the type in which a plurality of support carriages are mounted for movement along a head-rail channel and slat carriers are mounted on each carriage for turning movement about an upright axis. The carriages are interconnected to control the spacing between the carriages when in an extended position along the head-rail channel, and traverse mechanism is connected to a lead one of the carriages for moving the carriages between an extended and a retracted position. In order to maintain a fixed space between the blind slats and a side of the window opening, it is common practice to lock or anchor a carriage at a trail end of the stack of carriages against movement along the head-rail during normal operation of the blind. However, there are occasions, such as when cleaning the window, when it is desirable to move the blind slats away from the side edge of the window. Arrangements have heretofore been made, for example as disclosed in U.S. Pat. No. 3,157,223, for releasably retaining a trail carriage of a vertical blind at a selected location along the head-rail. However, in some vertical blind installations, it is important to releasably retain the trail carriage at a fixed location relative to the end of the head-rail, in a manner that does not obstruct the space in the head-rail between the trail carriage and the blind operating mechanism at the end of the head-rail, so as to enable use of other devices such as a vertical blind track protector disclosed in U.S. Pat. No. 5,090,467.

SUMMARY OF THE INVENTION

It is the object of the present invention to provide a vertical blind apparatus having means for releasably retaining the trail carriage at a selected location along the vertical blind head-rail, and which retaining means operates to reliably retain the trail carriage at the selected location during normal operation of the blind and which can be readily manually released to release the trail carriage, and which does not obstruct the space between the trail carriage and the blind operating mechanism at the end of the head-rail.

Accordingly, the present invention provides, in a vertical blind apparatus of the type having a head-rail channel and a plurality of panel support carriages guidably mounted on carriage support flanges on the side walls of the channel, a mechanism for releasably retaining the trail carriage at a selected location along the head-rail. The trail carriage retaining mechanism is formed of resilient synthetic resin material and includes an elongated base mounted on one side wall of the channel and an elongated latch member having forward and rear resilient end portions formed integrally with the base. The latch member has a forward ramp portion that diverges rearwardly from the forward end portion relative to one side wall of the channel; a rearwardly facing stop shoulder intermediate the ends of the latch member; and a finger pad portion rearwardly of the stop shoulder. The ramp portion is disposed in the path of movement of a portion of the trail carriage and the forward resilient portion of the latch member is arranged to yield and allow the ramp portion to be deflected laterally when the trail carriage is moved in a rearward direction along the path. The rearwardly facing stop shoulder is engageable with the trail carriage to inhibit forward movement of the trail carriage and a finger pad is provided on the latch member and operative, when pressed in a direction toward the side wall of a channel, to deflect the rear resilient portion and allow the latch member to shift toward the side wall of the channel and disengage the stop shoulder. The latch has a forwardly facing stop shoulder spaced rearwardly from the rearwardly facing stop shoulder for limiting rearward movement of the trail carriage.

DETAILED DESCRIPTION

Figure 1:
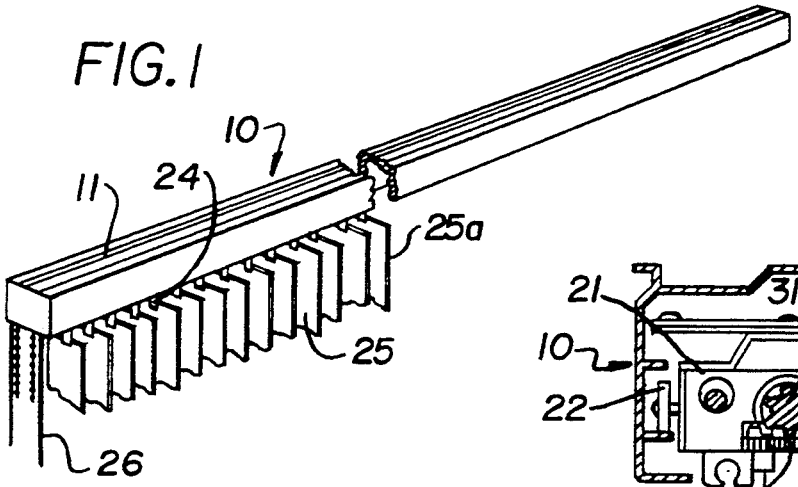
FIG. 1 is a fragmentary perspective view of a vertical blind.

The present invention relates to vertical blind apparatus of the type including an elongated head-rail channel 10 having a top wall 11, depending side walls 12 and inwardly extending carriage support flanges 13 on the side walls. An upper flange 14 is commonly provided on the side walls above the flanges 13, to limit lifting of the carriages off the support flanges. In the preferred embodiment illustrated, the side walls also have inwardly directed bottom flanges 15 spaced below the carriage support flanges 13, with the flanges 15 spaced apart to define a downwardly opening slot therebetween. A plurality of panel support carriages 21 are mounted as by guides such as wheels 22 on the carriage support flanges 13 for movement in a path lengthwise of the head-rail channel, and a panel or slat support 24 is mounted on each carriage and arranged to support a slat 25 for turning movement relative thereto about an upright axis. A means such as traverse cords 26 are provided for moving the carriage associated with a lead one of the slats designated 25*a* in FIG. 1 along the head-rail channel and mechanism such as a lazy tongs linkage shown at 28 in FIGS. 2 and 4, or collapsible spacer member, interconnect the carriages to control spacing therebetween when the carriages are in an extended condition. A mechanism is also provided for turning the slats in unison and, in the embodiment illustrated, a keyed shaft 31 extends lengthwise of the channel and is connected through gearing 32 (FIG. 4) on each carriage with the associated panel carrier 24 to rotate all the panel carriers in unison. Rotation means are provided to rotate the rod 31 and, in the embodiment illustrated, the rotation means is enclosed in a housing 33 at one end of the rod.

It is common practice to anchor or retain one carriage, hereinafter referred to as the trail carriage 21*b*, at a selected location along the head-rail to maintain a controlled light gap between the side of the window opening and the adjacent slat or panel when the lead carriage is extended and retracted along the head-rail during normal operation of the blind. In order to provide a better access to the window for cleaning or the like, the trail carriage retaining means is constructed and arranged so that the trail carriage can be released for movement away from its normal position. The trail carriage retaining means is formed of a resilient synthetic resin material such as polyethylene and includes an elongated base 41 that is mounted on one of the side walls of the head-rail channel, and an elongated latch member 42 having forward and rear resilient portions 43 and 44 formed integrally with the base. The latch member also includes a forward ramp portion 45 that diverges in a rearward direction from the resilient forward end portion 43 relative to the side wall of the channel; a rearwardly facing stop shoulder 46 intermediate the ends of the latch member, and a finger pad portion 47 spaced rearwardly from the stop shoulder 46. The latch member also includes a finger defining a forwardly facing stop shoulder 48 that is spaced rearwardly from the shoulder 46.

The trail carriage retainer is mounted on a side wall of the channel, preferably a side wall that faces inwardly of the room, at a location below the carriage support flange 13 and above the bottom flange 15. The base 41 of the carriage retainer extends alongside the side wall of the channel and the base has one or more projections 41*a* arranged to project through small openings in the side wall of the channel with enlarged heads on the projections to hold the retainer member in position on the side wall. The retainer member is disposed in a generally horizontal plane and the ramp portion 45 is disposed in the path of movement of a portion such as a depending ear 51 on the trail carriage 21*b*. The thickness of the ramp portion is greater than that of the forward flexible portion 43 and the forward flexible portion is sufficiently thin to function as a living hinge and allow the ramp portion to be deflected up laterally outwardly by the ear 51 on the trail carriage. The forwardly facing shoulder 48 is spaced from the rearwardly facing shoulder 46 a distance slightly greater than the thickness of the ear 51 and sufficient to straddle that portion of the carriage and allow the ramp portion to move outwardly to lock the trail carriage against movement. The rear flexible portion 44 has a generally U-shaped configuration and is sufficiently thin to flex when finger pressure is applied to the pad 47 and to allow the latch member to shift toward the side wall of the channel sufficient to disengage the stop shoulder 46 from the trail carriage. The forward and rear resilient portions 43 and 44 of the latch member also allow the latch member 42 to resiliently shift a limited amount in a direction lengthwise of the head-rail when the trail carriage abruptly engages either the forwardly facing shoulder 48 or the rearwardly facing shoulder 46, to minimize likelihood of damage to either the trail carriage or the retainer.

Figure 4:
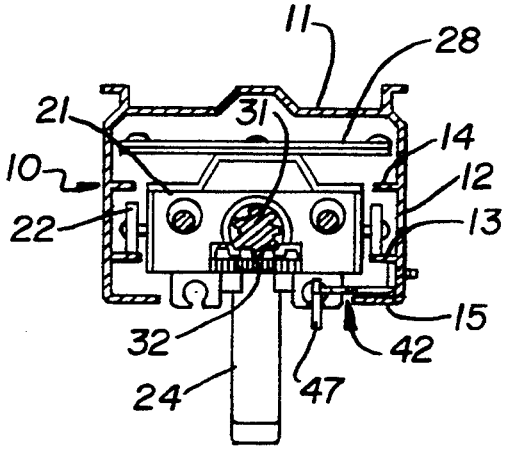
FIG. 4 is a transverse sectional view taken on a plane 4—4 of FIG. 2.
Figure 2:
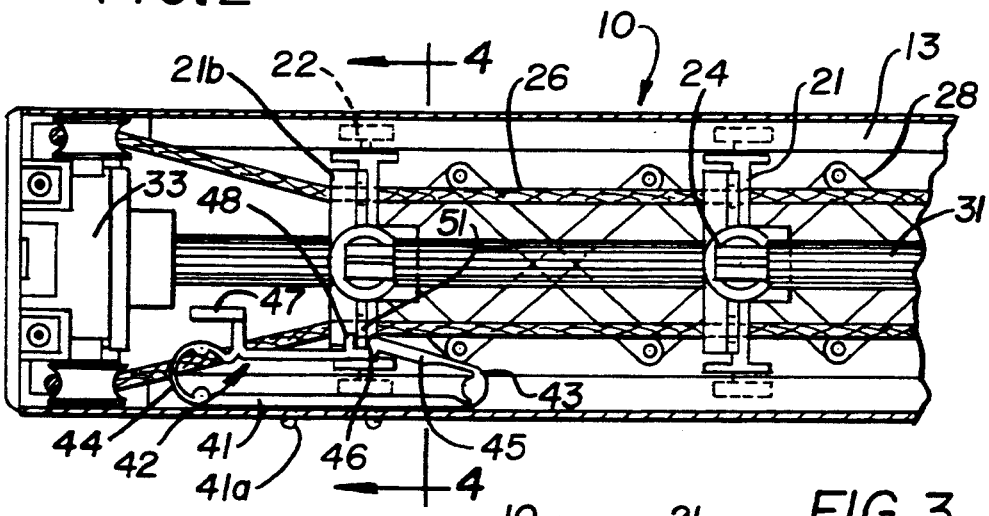
FIG. 2 is a fragmentary bottom view of the vertical blind with the bottom flanges removed and illustrating the trail carriage in a latched position.
Figure 3:
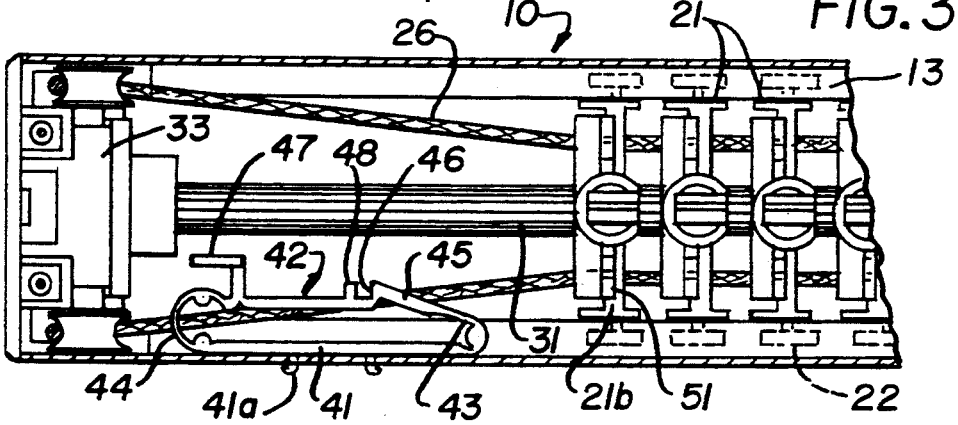
FIG. 3 is a fragmentary bottom view illustrating the trail carriage in a release condition.
Figure 6:
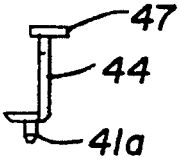
FIG. 6 is an end view of the carriage retaining means.
Figure 5:
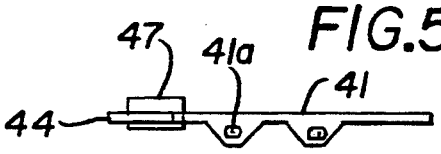
FIG. 5 is a side view of the carriage retaining means.

As will be seen from FIGS. 2–4, the trail carriage retainer is located along a front side wall of the head-rail closely adjacent the bottom thereof and the finger pad 47 projects downwardly below the head-rail so that it is readily accessible. Thus, the trail carriage retainer can be released by engaging the finger pad 47 and the front wall of the head rail between the thumb and forefinger to depress the rear end of the latch member to a released position. As will be seen from FIGS. 2–4, the trail carriage retainer does not obstruct the space between the trail carriage and the end housing.

The embodiments of the invention in which an exclusive property or privilege is claimed are defined as follows:

1. A vertical blind apparatus including an elongated head-rail channel having a top wall and depending side walls and inwardly extending carriage support flanges on the side walls, a plurality of panel support carriages mounted on the carriage support flanges for movement in a path lengthwise of the channel and including a lead carriage and a trail carriage, means connecting the carriages to control relative movement therebetween, means for selectively advancing and retracting the lead carriage, and means for retaining the trail carriage at a selected location along the head-rail, the improvement wherein said carriage retaining means includes an elongated base mounted on one side wall of the channel to extend lengthwise of the channel adjacent said selected location and an elongated latch member having forward and rear resilient end portions formed integrally with said base, the latch member having a forward ramp portion diverging rearwardly from the forward end portion relative to said one side wall of the channel; a rearwardly facing stop shoulder intermediate the ends of the latch member; and a finger pad rearwardly of said stop shoulder, the ramp portion being disposed in the path of movement of a portion of the trail carriage to be deflected laterally thereby when the trail carriage is moved in a rearward direction along said path and said rearwardly facing stop shoulder being engageable with the trail carriage to inhibit forward movement of the trail carriage, said finger pad, when pressed in a direction toward said one side wall, being arranged to shift the latch member toward the one side wall and disengage the stop shoulder from the trail carriage.

2. A vertical blind apparatus according to claim 1 including means on the latch member providing a forwardly facing stop shoulder spaced rearwardly from the rearwardly facing stop shoulder for limiting rearward movement of the trail carriage.

3. A vertical blind apparatus according to claim 1 wherein the carriage retaining means is mounted on said one side wall of the channel below the carriage support flange on that side wall.

4. A vertical blind apparatus according to claim 1 wherein said base and latch member are disposed in a generally horizontal plane below the carriage support flange on said one side wall.

5. A vertical blind according to claim 4 wherein said finger pad has a portion that extends downwardly below a plane through the bottom of the head-rail channel.

6. A vertical blind apparatus according to claim 1 wherein said one side wall has at least one opening extending therethrough and said base has a projection extending into said opening for mounting the retaining means on the channel.

7. A vertical blind apparatus according to claim 1 wherein said rear resilient end portion of the latch member has a generally U-shaped configuration.

8. A vertical blind apparatus according to claim 7 wherein said forward resilient end portion has a generally U-shaped configuration that is smaller than the U-shaped configuration of the rear resilient end portion of the latch member.

* * * * *